United States Patent [19]

Drori

[11] 4,000,853

[45] Jan. 4, 1977

[54] SPRINKLER HAVING IMPROVED WATER DISTRIBUTION

[76] Inventor: Mordeki Drori, 89 Zahal St., Kiron, Israel

[22] Filed: Mar. 29, 1976

[21] Appl. No.: 671,716

[30] Foreign Application Priority Data

Feb. 6, 1976 Israel ..... 48983

[52] U.S. Cl. ..... 239/230; 239/231; 239/512

[51] Int. Cl.[2] ..... B05B 3/08

[58] Field of Search ..... 239/DIG. 1, 230–232, 239/498, 499, 502, 503, 505, 507, 509, 510, 512, 521, 524

[56] References Cited

UNITED STATES PATENTS

| | | | |
|---|---|---|---|
| 2,654,635 | 10/1953 | Lazzarini | 239/230 |
| 2,745,699 | 5/1956 | Orr | 239/231 |
| 3,465,628 | 9/1969 | Chow | 239/232 X |
| 3,703,993 | 11/1972 | Schreiner | 239/231 |

*Primary Examiner*—Johnny D. Cherry
*Assistant Examiner*—Andres Kashnikow
*Attorney, Agent, or Firm*—Benjamin J. Barish

[57] ABSTRACT

A sprinkler having improved water distribution comprises an oscillating arm and a deflector carried thereby having a lower edge disposed so as to intercept an increasing area of the water jet section to deflect same downwardly during one direction of movement of the arm, and a decreasing area of the water jet section to deflect same downwardly during the opposite direction of movement of the arm.

9 Claims, 11 Drawing Figures

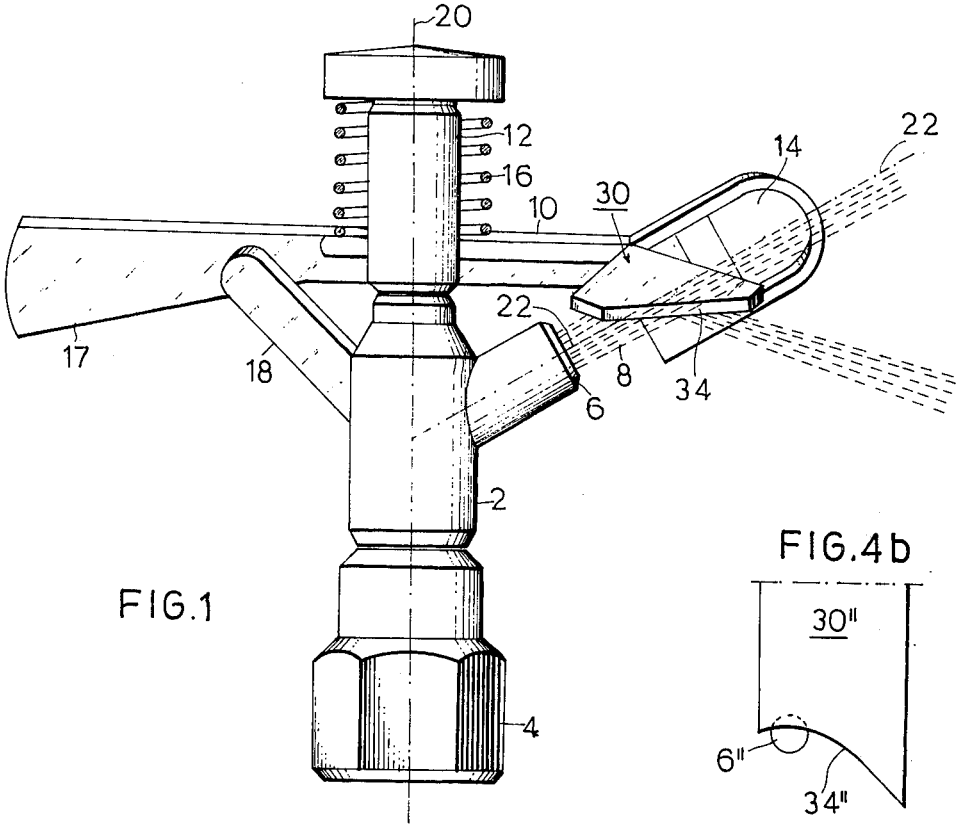
FIG.1
FIG.4b
FIG.2
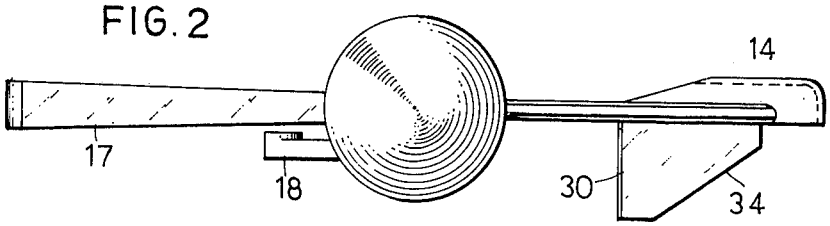
FIG.4a
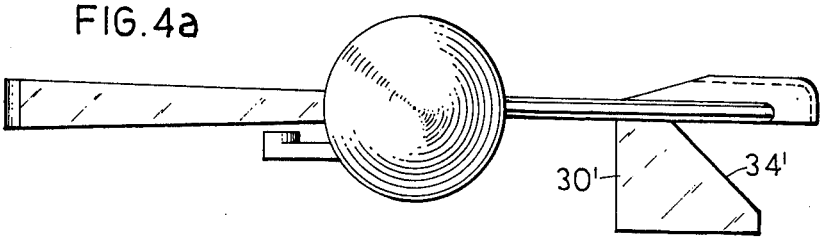

SPRINKLER HAVING IMPROVED WATER DISTRIBUTION

BACKGROUND OF THE INVENTION

The present invention relates to sprinklers. The invention is particularly applicable with respect to rotary sprinklers used in water irrigation systems, and is therefore described below with respect to that application.

One of the important requirements of a water sprinkler used for irrigation purposes is that there be a substantially uniform distribution of the water around the area covered by the sprinkler. Most conventional water sprinklers of the rotary type are not entirely satisfactory in this respect. Many arrangements have been proposed for increasing the uniformity of distribution of the sprinkled water, but as a rule, the known arrangements are of relatively complicated construction and are therefore costly to produce and to maintain.

SUMMARY OF THE INVENTION

An object of the present invention is to provide a sprinkler, particularly a rotary sprinkler, of extremely simple and inexpensive construction and having a substantially uniform distribution of the water.

According to a broad aspect of the present invention, there is provided a sprinkler, comprising: a sprinkler head connectable to a water supply pipe and having a nozzle through which the water issues in the form of a jet; a spring-biassed pivotably-mounted arm impinged by the water jet and oscillated thereby; and a deflector carried by the arm and oscillated therewith across the path of the water jet so as to be impinged thereby along a line of impingement as the deflector oscillates back and forth along the path of the water jet. The deflector includes a lower edge disposed at an angle to and intercepting the line of impingement of the deflector as it oscillates back and forth across the path of the water jet such that the lower edge of the deflector intercepts an increasing area of the water jet section to deflect it downwardly during one direction of movement of the arm, and a decreasing area of the water jet section to deflect same downwardly during the opposite direction of movement of the arm, to thereby distribute the sprinkled water substantially uniformly from the sprinkler nozzle during the oscillation of the arm.

According to another feature in the preferred embodiment of the invention described below, the deflector is oriented so that the line of impingement of the water jet thereon during the oscillation of the deflector is substantially at a right angle to the axis of the nozzle to thereby produce no significant lateral force aiding or impeding the oscillation of the arm by the water jet.

The invention is particularly useful with respect to rotary sprinklers, wherein the sprinkler head is rotatably mounted and includes an abutment impacted by the arm during its oscillations to rotate the sprinkler.

According to a further feature in the preferred embodiment of the invention described below, the axis of the nozzle and the axis of rotation of the sprinkler head are in a common plane, the deflector being mounted at a right angle to said common plane.

According to a further feature in the described embodiment, the deflector is planar and forms an acute angle to the plane defined by the nozzle axis and the line of impingement of the water jet on the deflector.

The lower edge of the deflector may be formed and oriented with respect to the water jet so as to produce the desired pattern of water distribution for any particular application. In one described embodiment, the lower edge of the deflector is a straight edge, and in another, it is a curved edge.

The invention is described below with respect to two types of sprinkler heads. In one type, the oscillating arm loads its spring during the forward stroke of its oscillations after impingement by the water jet, and impacts the sprinkler head to rotate same during the return stroke of its oscillations. In the second described type, the oscillating arm impacts the sprinkler head to rotate same during the forward stroke of its oscillations, and is returned by the spring during the return stroke of its oscillations.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a side elevational view of a conventional type of rotary sprinkler modified to incorporate the present invention;

FIG. 2 is a top plan view of the sprinkler of FIG. 1;

FIGS. 4*a* and 4*b* illustrate possible modifications in the deflector edge of the deflector;

DESCRIPTION OF THE PREFERRED EMBODIMENT

Figures 3A, 3B, 3C, 3D:
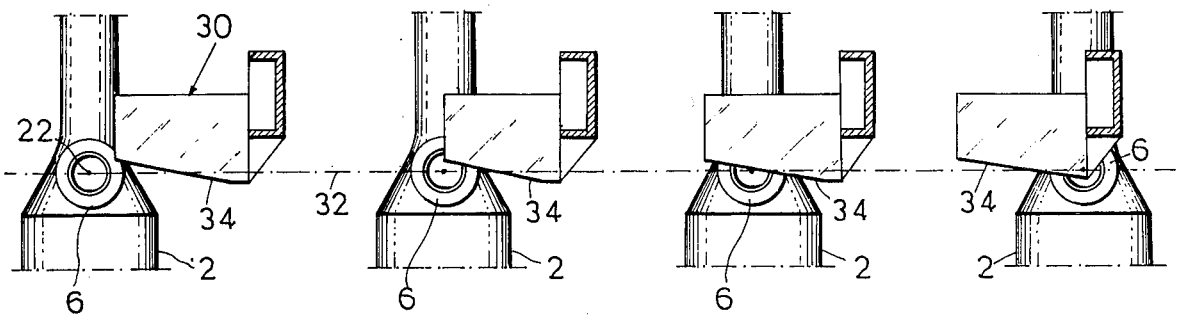
FIGS. 3*a*–3*d* are fragmentary front elevational views illustrating the various positions of the deflector with respect to the water jet nozzle during the oscillation of the deflector.

The sprinkler illustrated in FIGS. 1 and 2 is of a conventional type including a sprinkler head 2 connectable at its lower end 4 to a water supply pipe, and having a nozzle 6 through which the water issues in the form of a jet 8. An oscillating arm 10 is rotatably mounted on a pin 12 carried at the upper end of the sprinkler head 2. Arm 10 includes a portion 14 adapted to be impinged by the water jet rotatably for pivoting the arm in one direction about pin 12, the arm being returned by a spring 16 which causes the opposite end 17 of the arm to impact an abutment 18 carried by the sprinkler head 2. Thus, arm 10 is impinged by the water jet 8 to load its spring 16 during the forward stroke, and impacts abutment 18 of the sprinkler head 2 to rotate the sprinkler during the return stroke.

In the sprinkler of FIGS. 1 and 2, the axis of rotation 20 of the sprinkler head 2 is common to the axis of oscillation of arm 10 about its pin 12, and this axis 20 is intersected by the axis 22 of nozzle 6, so that both axes 20 and 22 lie in a common plane.

A deflector, generally designated 30, is carried by oscillating arm 10 so as to be oscillated therewith in front of nozzle 6 and across the path of the water jet 8. Thus, the deflector is impinged by the water jet along a line, shown at 32 in FIGS. 3*a* –3*d*, as the deflector oscillates back and forth across the path of the water jet.

As shown in FIGS. 1, 2, and 3*a* –3*d*, deflector 30 is planar and is inclined at an acute angle with respect to the plane of nozzle axis 22 and the line 32 of impingement of the water jet on the deflector. The lower edge 34 of the deflector is at an acute angle to, and intercepts, the line of impingement 32 of the water jet on the deflector. Thus, the lower edge 34 of deflector 30 intercepts an increasing area of the water jet section to deflect same downwardly during one direction of movement of the deflector, and a decreasing area of the water jet section to deflect same downwardly during the opposite direction of movement of the deflector.

The foregoing is more clearly shown by FIGS. *3a–3d*, illustrating four different positions of the deflector with respect to the sprinkler nozzle 6. The center axis of the nozzle is shown at 22, and the line of impingement of the jet on the deflector during its oscillations is shown at 32. FIG. *3a* illustrates the position of sprinkler 30, at a point in the return stroke of the oscillating arm 10 after portion 14 of the arm has been impacted by the water jet 8 to swing the arm about pin 12 and the arm has started to return back to its initial position (under the influence of spring 16) just before impacting abutment 18 to rotate the sprinkler head 2.

As shown in FIG. *3a*, the lower edge 34 of deflector 30 has not yet been impinged by the water jet issuing through nozzle 6, and therefore the water jet issues unrestrictedly through the nozzle and will accordingly transverse the maximum distance from the sprinkler. In the condition illustrated in FIG. *3b*, the deflector 30 has moved closer to the nozzle so that the edge 34 of the deflector intersects a small cross-sectional area of the water jet issuing through nozzle 6. This intersected section of the water jet is deflected downwardly so that the remaining, relatively larger, section of the water jet issues unrestrictedly from the sprinkler. FIG. *3c* illustrates the position of deflector wherein its lower edge 34 intersects approximately one-half the section of the water jet, deflecting same downwardly, and permitting the remainder to issue unrestrictedly from the sprinkler; and FIG. *3d* illustrates the position of deflector 34 wherein it has intercepted substantially the complete section of the water jet deflecting same downwardly.

After the deflector has passed the position of FIG. *3d*, oscillating arm 10, on which it is carried, impacts the sprinkler head to rotate same and then receives another impact from the water jet, driving the arm through another forward stroke.

An important feature of the deflector illustrated in FIGS. 1 and 2 is that the deflector is oriented so as not to produce any significant lateral force aiding or impeding the oscillation of the arm by the water jet. For this purpose, the plane of deflector 30 is oriented so that the line of impingement 32 of the water jet on the deflector, as the deflector is oscillated back and forth in front of nozzle 6, is substantially at right angles to the axis 22 of the nozzle. Thus, the force of impingement of the water jet on the deflector will have a forward component coaxial with nozzle axis 22, and an upward component at right angles to nozzle axis 22, but no significant lateral component which might aid or impede the oscillation of the arm by the water jet impacting the arm.

Deflector 30 may be fixed in any suitable manner to arm 10, being preferably formed integrally with that arm. Existing rotary sprinklers, however, may be easily converted to incorporate the deflector of the present invention by merely mounting the deflector 30, as by adhesive or by fasteners (see FIG. 7), to oscillating arm.

FIG. *4a* illustrates a variation wherein the jet-intersecting edge 34' of the deflector 30' is cut in the opposite direction.

FIG. *4b* illustrates a variation wherein the edge 34'' of the deflector 30'', instead of being straight, is curved. These and other variations may be used to provide the desired distribution of water according to a particular application.

Figure 5:
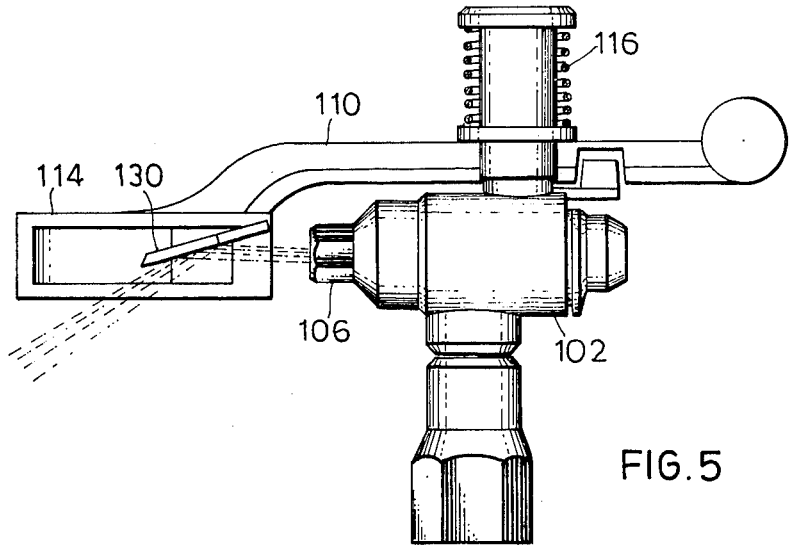
FIG. 5 is a side elevational view of another form of rotary sprinkler incorporating the present invention.
Figure 7:
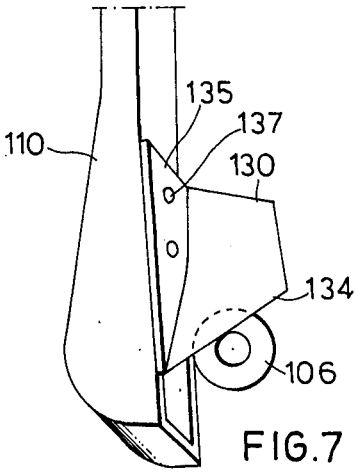
FIG. 7 is an enlarged fragmentary front view illustrating the disposition of the deflector with respect to the water jet nozzle in the sprinkler of FIGS. 5 and 6.
Figure 6:
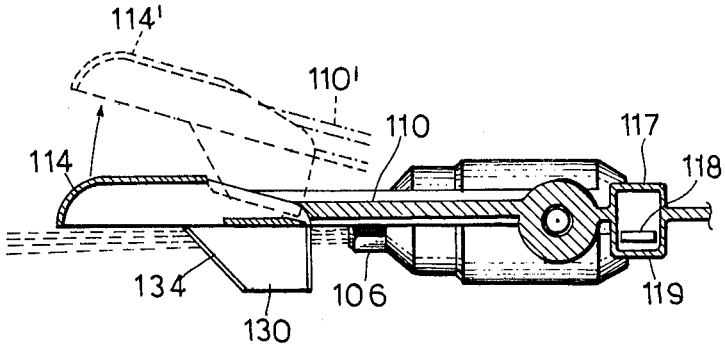
FIG. 6 is a top plan view of the sprinkler of FIG. 5.

FIGS. 5–7 illustrate the invention embodied in another type of sprinkler particularly for use with low-energy water jets wherein the energy within the water jet may not be sufficient to rotate a sprinkler of the more conventional type of FIGS. 1 and 2. In the sprinklers of FIGS. 5–7, the operation of the oscillating arm is reversed. Thus, in the forward stroke immediately after the water jet entering from nozzle 6 impacts portion 114 of the oscillating arm 111, the arm is moved laterally to the position illustrated in broken lines in FIG. 6, wherein the shoulder 117 formed at the end of the arm impacts against an abutment 118 carried by sprinkler head 102, thereby imparting a clockwise movement to the sprinkler head. In the return stroke, sprinkler 116, which was loaded during the forward stroke, returns arm 112 to its normal, full-line position illustrated in FIG. 6.

In the embodiment of FIGS. 5–7, deflector 130 is likewise carried on the oscillating arm 114 so as to be oscillated therewith across the path of the water jet issuing from nozzle 116. Deflector 130 is mounted to arm 110 by means of a mounting extension 135 formed at right angles to the plane of deflector 130 and secured to the arm by means of fasteners 137. Deflector 130 is otherwise the same as deflector 30 in the previously described embodiment, and includes the lower edge 134 effective to intercept an increasing area of the water jet section to deflect it downwardly during one direction of movement of the deflector, and a decreasing area of the water jet section to deflect same downwardly during the opposite direction of movement of the deflector to thereby distribute the sprinkled water substantially uniformly from the sprinkler nozzle during the oscillation of arm 110.

Many other variations, applications, and modifications of the illustrated embodiments will be apparent.

What is claimed is:

1. A sprinkler comprising: a spinkler head connectable to a water supply pipe and having a nozzle through which the water issues in the form of a jet; a spring-biassed pivotably-mounted arm impinged by the water jet and oscillated thereby; and a deflector carried by said arm, and oscillated therewith across the path of the water jet so as to be impinged thereby along a line of impingement as the deflector oscillates back and forth along the path of the water jet; said deflector including a lower edge disposed at an angle to and intercepting the line of impingement of the deflector as it oscillates back and forth across the path of the water jet such that the lower edge of the deflector intercepts an increasing area of the water jet section to deflect it downwardly during one direction of movement of the arm, and a decreasing area of the water jet section to deflect same downwardly during the opposite direction of movement of the arm, to thereby distribute the sprinkled water substantially uniformly from the sprinkler nozzle during the oscillation of the arm.

2. A sprinkler according to claim 1, wherein said deflector is oriented so that the line of impingement of the water jet thereon during the oscillation of the deflector is substantially at a right angle to the axis of the nozzle to thereby produce no significant lateral force aiding or impeding the oscillation of the arm by the water jet.

3. A sprinkler according to claim 2, wherein the sprinkler head is rotatably mounted and includes an abutment impacted by the arm during its oscillations to rotate the sprinkler.

4. A sprinkler according to claim 3, wherein the axis of the nozzle and the axis of rotation of the sprinkler head are in a common plane, and wherein the deflector is mounted at a right angle to said common plane.

5. A sprinkler according to claim 4, wherein the deflector is planar and forms an acute angle to the plane defined by the nozzle axis and the line of impingement of the water jet on the deflector.

6. A sprinkler according to claim 5, wherein said lower edge of the deflector is a straight edge.

7. A sprinkler according to claim 5, wherein said lower edge of the deflector is a curved edge.

8. A sprinkler according to claim 3, wherein the oscillating arm loads its spring during the forward stroke of its oscillations after impingement by the water jet, and impacts the sprinkler head to rotate same during the return stroke of its oscillations.

9. A sprinkler according to claim 3, wherein the oscillating arm impacts the sprinkler head to rotate same during the forward stroke of its oscillations, and is returned by the spring during the return stroke of its oscillations.

* * * * *